US011795601B2

(12) United States Patent
Masters, Jr.

(10) Patent No.: US 11,795,601 B2
(45) Date of Patent: Oct. 24, 2023

(54) MAXIMIZING THE DRY RATE OF CLOTHES TUMBLING COMBINATION WASHER/DRYER WITH A SEAL

(71) Applicant: Whirlpool Corporation, Benton Harbor, MI (US)

(72) Inventor: Roy Edward Masters, Jr., Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 112 days.

(21) Appl. No.: 17/094,280

(22) Filed: Nov. 10, 2020

(65) Prior Publication Data

US 2022/0145516 A1 May 12, 2022

(51) Int. Cl.
*D06F 37/26* (2006.01)
*D06F 25/00* (2006.01)
*D06F 58/04* (2006.01)

(52) U.S. Cl.
CPC ..... *D06F 37/266* (2013.01); *D06F 25/00* (2013.01); *D06F 58/04* (2013.01)

(58) Field of Classification Search
CPC ..... D06F 25/00; D06F 37/266; D06F 58/04
See application file for complete search history.

(56) References Cited

U.S. PATENT DOCUMENTS 1,957,585 A 5/1934 Gratian
2,569,515 A 10/1951 Collins
2,864,394 A 12/1958 Gustav
3,066,695 A 12/1962 Allen
3,163,029 A 12/1964 Jacobs
3,247,690 A * 4/1966 Kahn ..... D06F 43/02 68/19.2
3,584,650 A 6/1971 Macaulay
3,750,304 A 8/1973 Ghadiali
3,807,444 A 4/1974 Fortune
3,875,686 A 4/1975 Smoot
4,006,534 A 2/1977 Coffman
4,669,200 A 6/1987 Carr
4,835,882 A 6/1989 Dongelmans
5,325,892 A 7/1994 Japuntich et al.
5,469,883 A 11/1995 Lee
5,601,117 A 2/1997 Lewis et al.
6,006,445 A 12/1999 Large
(Continued)

FOREIGN PATENT DOCUMENTS

CN 106283561 A 1/2017
CN 107558092 A 1/2018
(Continued)

OTHER PUBLICATIONS

Machine translation of JP 2005-304989 A. (Year: 2005).*
(Continued)

*Primary Examiner* — Joseph L. Perrin
(74) *Attorney, Agent, or Firm* — Harness, Dickey & Pierce, PLC

(57) ABSTRACT

A combination washer/dryer machine includes a rotatable drum inside a cabinet. The drum has an external surface. A tub is positioned inside the cabinet. The drum is rotatable in the tub. The tub has an inner surface. A seal contacts the exterior surface of the drum and the inner surface of the tub during drying operation to minimize the bypass of drying air.

19 Claims, 3 Drawing Sheets

(56) References Cited

U.S. PATENT DOCUMENTS

| | | | | |
|---|---|---|---|---|
| 6,796,150 | B2 * | 9/2004 | Bringewatt | D06F 31/005 68/58 |
| 7,757,521 | B2 | 7/2010 | Hong | |
| 8,499,473 | B2 | 8/2013 | Dal Ben et al. | |
| 8,516,716 | B2 | 8/2013 | Dal Ben et al. | |
| 9,580,856 | B1 | 2/2017 | Schurr | |
| 9,970,705 | B2 | 5/2018 | Lowe | |
| 10,066,336 | B2 | 9/2018 | Schurr | |
| 10,196,772 | B2 | 2/2019 | Lee et al. | |
| 2006/0005581 | A1 * | 1/2006 | Banba | D06F 25/00 68/5 R |
| 2008/0223084 | A1 | 9/2008 | Kuwabara | |
| 2010/0229607 | A1 * | 9/2010 | Persson | D06F 25/00 68/19 |
| 2013/0174435 | A1 * | 7/2013 | Rockwell | F26B 11/024 34/108 |
| 2015/0040417 | A1 * | 2/2015 | Arcarons Alibes | D06F 58/04 34/130 |
| 2020/0270793 | A1 * | 8/2020 | Kim | D06F 58/04 |

FOREIGN PATENT DOCUMENTS

| | | | |
|---|---|---|---|
| DE | 3929023 | C1 | 9/1990 |
| DE | 19828243 | A1 | 12/1999 |
| DE | 19907602 | A1 | 8/2000 |
| DE | 102008043348 | A1 | 5/2010 |
| EP | 1559825 | A1 | 8/2005 |
| EP | 1790768 | A2 | 5/2007 |
| EP | 2850239 | A1 | 3/2015 |
| EP | 3469135 | A1 | 4/2019 |
| EP | 3543393 | A2 | 9/2019 |
| EP | 3741898 | A1 | 11/2020 |
| EP | 3995615 | A1 | 5/2022 |
| GB | 2297588 | A | 8/1996 |
| JP | 03026293 | | 2/1991 |
| JP | 2004008683 | A | 1/2004 |
| JP | 2005-304989 | A | 11/2005 |
| JP | 2006-122697 | A | 5/2006 |
| JP | 2007-061548 | A | 3/2007 |
| JP | 4444016 | B2 | 3/2010 |
| JP | 4541023 | B2 | 9/2010 |
| JP | 4945154 | B2 | 6/2012 |
| KR | 20050037187 | A | 4/2005 |
| KR | 100529954 | B1 | 11/2005 |
| KR | 100546613 | B1 | 1/2006 |
| WO | 2008148508 | A1 | 12/2008 |
| WO | 2009041345 | A1 | 4/2009 |
| WO | WO-2014-181493 | A1 | 11/2014 |
| WO | 2016050295 | A1 | 4/2016 |
| WO | 2018093205 | A2 | 5/2018 |
| WO | 2018171526 | A1 | 9/2018 |

OTHER PUBLICATIONS

European Search Report for EP21205375, dated Mar. 22, 2022 (76 Pages).

European Search Report for EP Application No. 22177103.3-1016, dated Dec. 2, 2022 (77 Pages).

European Search Report for EP21214203.08-1016, dated May 10, 2022 (78 Pages).

* cited by examiner

MAXIMIZING THE DRY RATE OF CLOTHES TUMBLING COMBINATION WASHER/DRYER WITH A SEAL

FIELD

The present disclosure relates to a combination washer/dryer machine and, more particularly, to a combination washer/dryer machine with a seal to maximize the dry rate of clothes tumbling in the machine.

BACKGROUND

In combination washers/dryers, it is difficult to provide a drying cycle without a lengthy finishing drying time. Several reasons exist for the lengthy drying time of the clothes within the drum. One such reason is a gap exist between the drum and tub. The gap enables air to bypass the drum. Thus, the drying air exits the machine without providing its heated air to the clothes within the drum. Thus, the drying cycle is inefficient and accordingly necessitates a longer drying time.

Accordingly, it would be desirable to provide a combination washer/dryer machine with an efficient drying cycle time. It would also be desirable to utilize all of the created drying air and pass it into the drum for its intended drying purpose. Thus, it is desirable to eliminate bypasses around the drum. Thus, drying air would be forced to enter into the drum. Accordingly, with all the drying air forced into the drum, this would, in turn, reduce drying cycle time.

Accordingly, it is desirable to provide a combination washer/dryer machine that overcomes the deficiencies of the prior art. It is desirable to provide a combination washer/dryer machine that provides a flow restriction to avoid air from bypassing the drum. Thus, it is desirable to move substantially all of the generated heated air enter into the drum.

SUMMARY

In accordance with the present disclosure, a combination washer/dryer machine comprises a rotatable drum inside of a cabinet. The drum has an external surface. A tub is positioned inside of the cabinet. The drum is rotatable inside of the tub. The tub has an inner surface. A seal contacts the exterior surface of the drum and the inner surface of the tub during a drying operation to minimize the bypass of drying air. The rotatable drum has a cylindrical shape with a cylindrical sidewall and an end wall. The seal is positioned in contact with the exterior surface of the cylindrical sidewall and the tub. Alternatively, the seal is in position in contact with the exterior surface of the endwall and the tub. The seal may include a first portion extending from the drum and a second portion extending from the tub. First and second portion contact one another to provide a flow restriction contact seal. Alternatively, the seal may include a first portion extending from the drum and the second portion extending from the tub, where the first and second portions form a labyrinth pathway with one another to provide a flow restriction.

Accordingly, to a second embodiment of the disclosure, a combination washer/dryer comprises a cabinet with a door enabling access into the cabinet. Controls operate the washer/dryer machine. A washing system and a drying system are provided. A rotatable drum is positioned inside the cabinet. The drum has an external surface. A tub is positioned inside of the cabinet. The drum is rotatable inside the tub. The tub has an inner surface. A seal contacts the exterior surface of the drum and the inner surface of the tub during the drying operation to minimize the bypass of drying air. The rotatable drum has a cylindrical shape with a cylindrical sidewall and an end wall. The seal is positioned in contact with the exterior surface of the cylindrical sidewall and the tub. Alternatively, the seal is in contact with the exterior surface of the endwall and the tub. The seal may include a first portion extending from the drum and a second portion extending from the tub. First and second portion contact one another to provide a flow restriction. Alternatively, the seal may include a first portion extending from the drum and the second portion extending from the tub, where the first and second portions form a labyrinth pathway with one another to provide flow restriction.

According to a third aspect of the disclosure, a combination washer/dryer machine drum and tub combination comprises a drum and a tub with the drum positioned inside of the tub. A seal contacts the exterior surface of the drum and the inner surface of the tub during a drying operation to minimize the bypass of drying air. The rotatable drum has a cylindrical shape with a cylindrical sidewall and an end wall. The seal is positioned in contact with the exterior surface of the cylindrical sidewall and the tub. Alternatively, the seal is in position in contact with the exterior surface of the endwall and the tub. The seal may include a first portion extending from the drum and a second portion extending from the tub. First and second portion contact one another to provide a flow restriction. Alternatively, the seal may include the first portion extending from the drum and the second portion extending from the tub, where the first and second portions form a labyrinth pathway with one another to provide the flow restriction.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
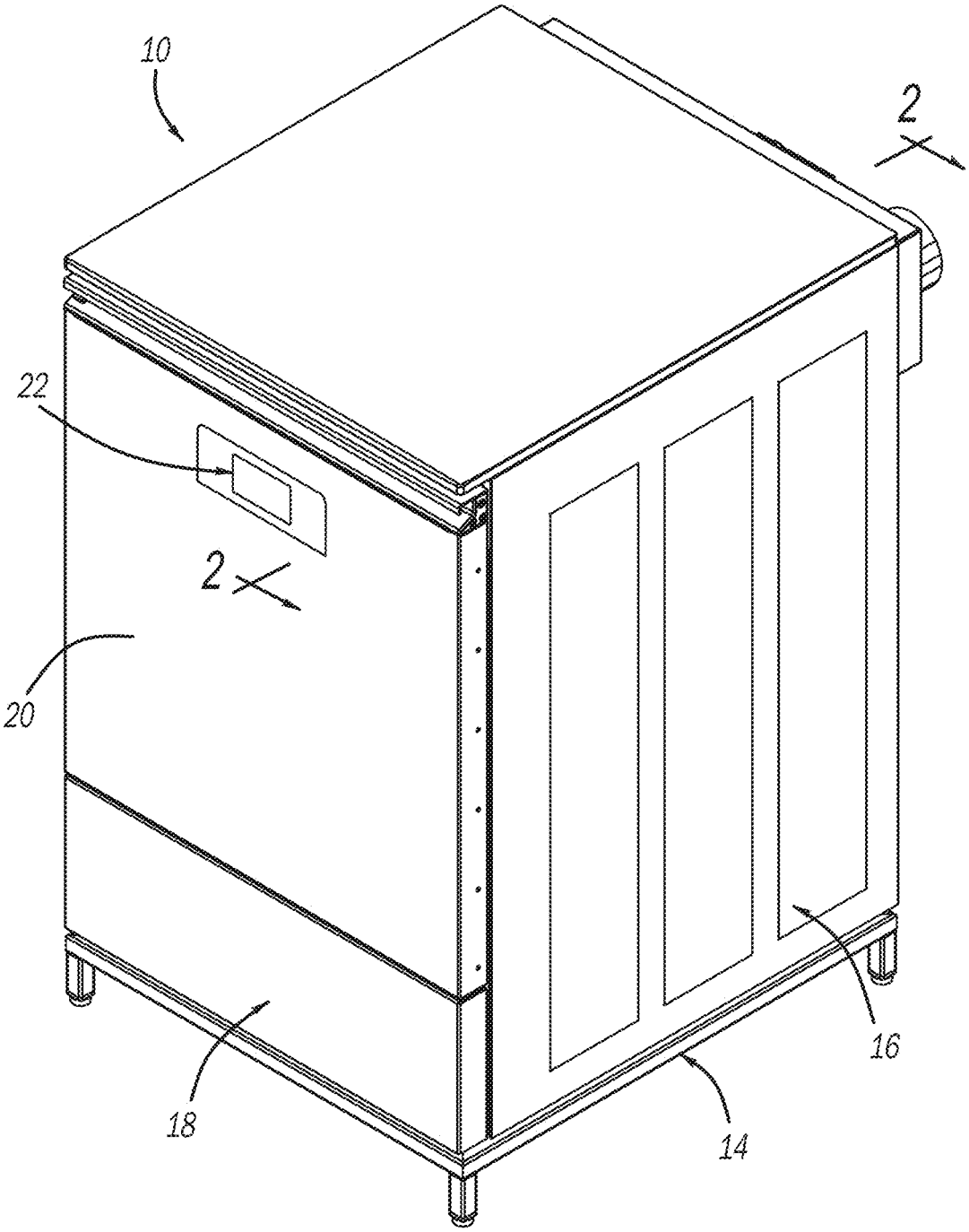
FIG. 1 is a perspective view of a combination washer/dryer machine in accordance with the disclosure.

Example embodiments will now be described more fully with reference to the accompanying drawings.

Turning to the figures, a combination washer/dryer machine is illustrated and designated with the reference numeral 10. The combination washer/dryer machine 10 includes a cabinet 14 having a plurality of panels 16. The front panel 18 includes a door 20 to enable access into the combination washer/dryer machine 10. Controls 22 are positioned on the front panel 18. The controls control the operation of the combination washer/dryer machine.

Figure 2:
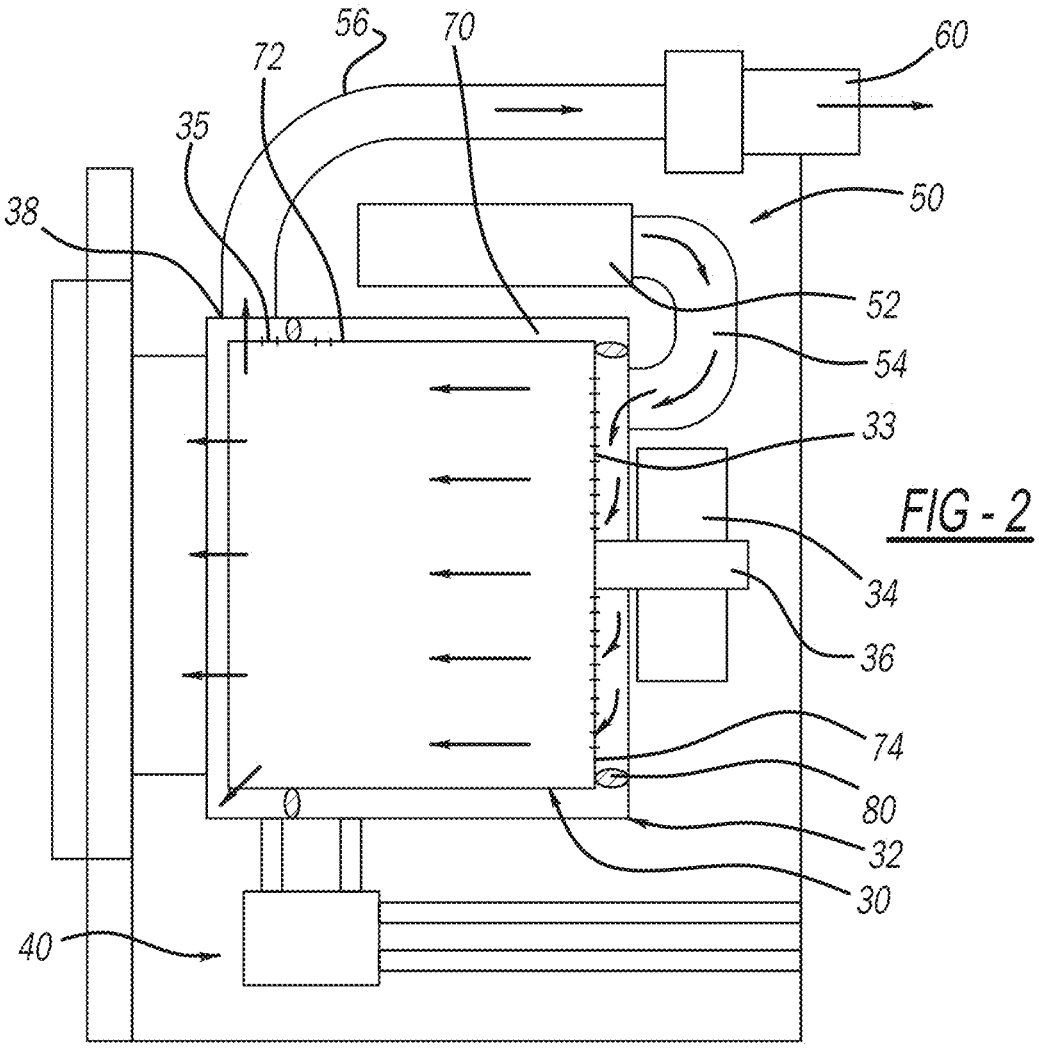
FIG. 2 is a schematic view of cross-section of the washer/dryer machine of FIG. 1.

Turning to FIG. 2, a cross section of the washer/dryer machine 10 is illustrated. The combination washer/dryer machine 10 includes a drum 30 rotational positioned within a tub 32. The drum 30 is rotated via a motor 34 and shaft 36. A conventional washing circuit 40 provides for washing of clothes within the drum 30. A conventional heating circuit 50 provides heat for drying the clothes within the drum 30.

The heating circuit 50 includes a heater 52 with a conduit 54 passing heated air into the tub 32. The drum 30 includes apertures 33 in end wall 74 that enable the heated air to enter into the drum 30. Also, the drum 30 includes apertures 35 in cylindrical sidewall 72 that enable the heated air to exit the drum 30. Also, an outlet 38 on the tub 32 enables exit of the air, Piping or conduit 56, connected with outlet 38, exits the air, via a blower or fan 58, to an exhaust tube 60. Thus, the used air is exhausted from the combination washer/dryer machine 10. The exhaust tube 60 is connected with piping in the building to exit air to ambient.

A gap 70 is formed between the drum 30 and the tub 32. The gap 70 provides for the recovery of water or the Ike between the drum 30 and tub 32. The drum 32 has a cylindrical sidewall 72 and an end wall 74. Likewise, the tub 32 has a cylindrical wall 76 and an endwall 78. The external surface of the cylindrical sidewall 72 and end wall 74 face an inner surface of the tub 32.

The seal 80 may be connected to the drum 30 or tub 32. Alternatively, the seal 80 may be connected to both the drum 30 and tub 32. The seal 80 is positioned either between the end wall 74 of the drum 30 and the endwall 78 of the tub 32 or the cylindrical sidewall 72 of the drum 30 and the cylindrical wall 76 of the tub 32. Additionally, it could be positioned on both. Thus, the seal 80 is in contact with the drum 30 and tub 32 during drying operation of the combination washer/dryer machine 10. The contact enhances the flow restriction between the drum 30 and tub 32. Thus, the flow restriction avoids heating air from bypassing the drum 30. Thus, the seal 80 provides that essentially all of ne drying airflow is passed into the drum 30.

Figure 3:
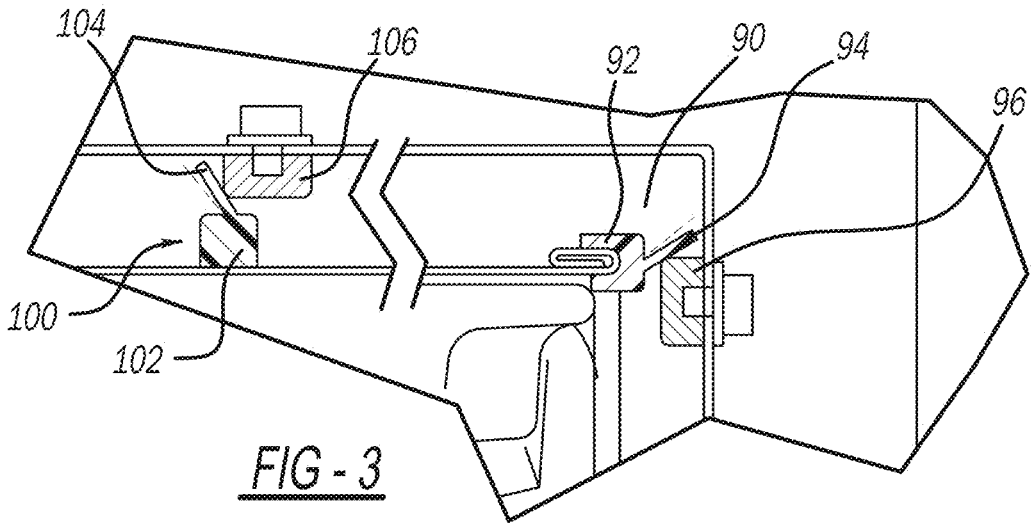
FIG. 3 is an exploded cross-sectional view of the sealing elements of FIG. 2.
Figure 4:
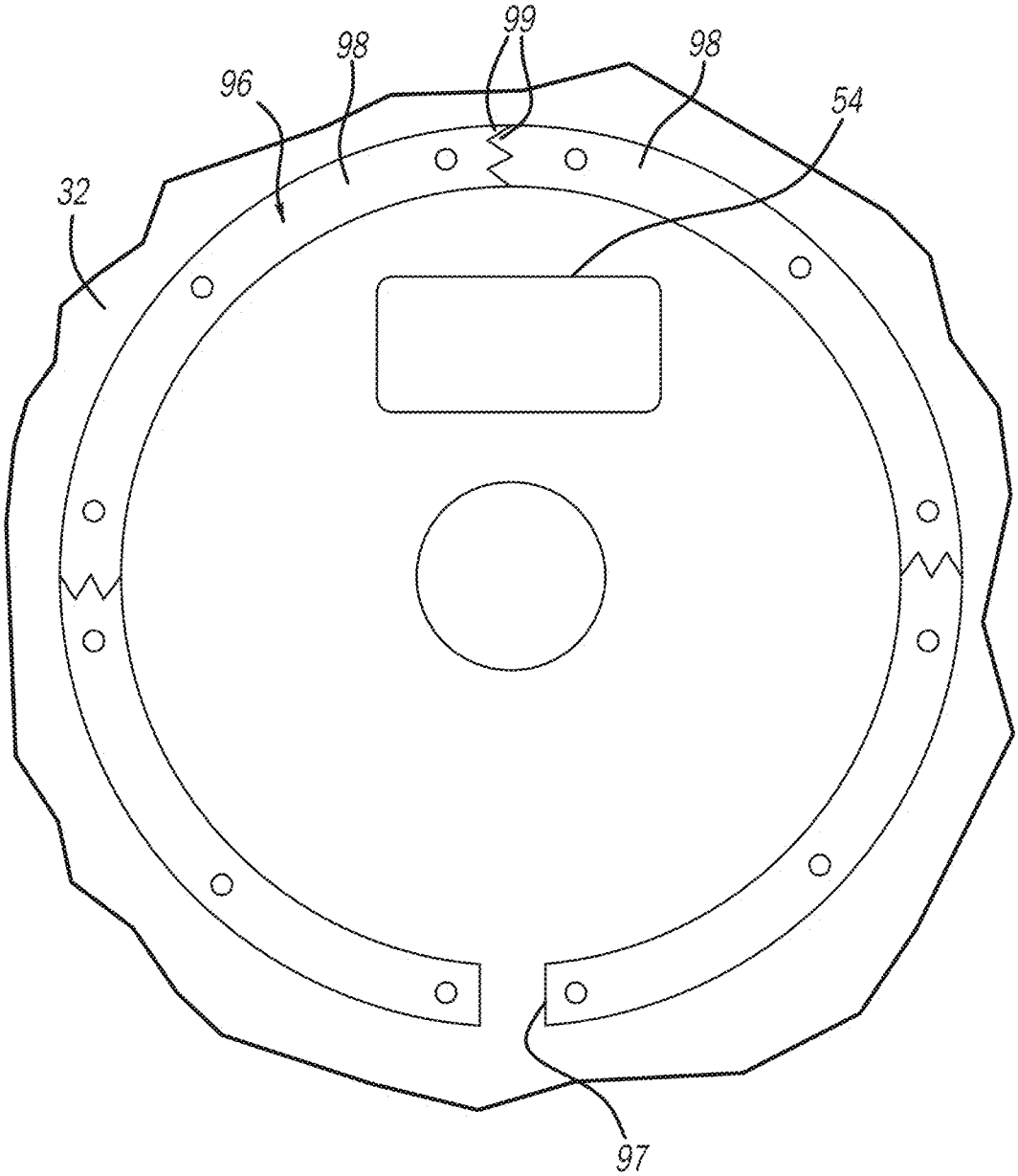
FIG. 4 is an elevation view of the ring on the tub.

FIG. 3 illustrates a two piece seal design. A seal 90 includes a securing portion 92 and a finger 94. Preferably, due to the high heat created during the heating cycle, the seal is manufactured from the silicone material or the like. A ring 96 is attached to the tub 32. The ring 96 extends from the tub to provide a resting surface for the finger 94. Thus, during rotation of the drum 30 during the drying cycle, the finger 94 contacts the ring 96. This provides a restriction so that during drying, the drying air is forced into the drum 30 and does not bypass the drum 30, via the gap, as in the prior art combination washer/dryer machines.

The ring 96 may include a plurality of pieces 98 secured to the tub 32. The pieces 98 may include key portions 99 to connect the ring 96 together. The ring 96 includes a small gap 97 at above the bottom of the ring 96. This enables trapped water to exit the ring 96. Additionally, the ring may be inlayed into the tub 32 and the finger 94 would extend onto the surface of the ring 96. Likewise, the ring 96 could be positioned onto the drum 30 and the seal 90 could extend from the tub 32.

Turning to FIG. 3, a seal 100 is positioned about the cylindrical sidewall 72 of the drum 30. The seal connecting portion 102 includes a finger 104. The finger 104 seals against a ring 106 positioned on the tub 32. Accordingly, the seal 100 could be positioned in various positions along the drum 30 and tub 32.

This enhances the drying cycle as well as the efficiency of the drying of the clothes within the drum. Additionally, the seal could have a very restrictive flow path between the drum or tub or between sealing portion that extended from the tub and drum. Thus, a first portion of the seal may extend from the drum and a second portion of the seal may extend from the tub. The first and second portions would contact one another to provide the seal, thus ensuring that the heated air passes into the drum.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A combination washer/dryer machine, comprising:

a rotatable drum inside a cabinet, the drum has an external surface and is rotatable by a shaft;

a tub positioned inside the cabinet, the drum rotatable in the tub, the tub has an inner surface; and a seal including a finger and a securing portion that is attached to the external surface of the drum and a ring that is attached to the inner surface of the tub and provides a resting surface for the finger during a drying cycle, wherein the finger of the seal is flexible and extends radially outward away from the shaft at an oblique angle relative to the securing portion such that the finger remains in contact with the ring during the drying cycle to provide a flow restriction that forces drying air into the drum and minimizes bypass of the drying air.

2. The combination washer/dryer machine of claim 1, wherein the rotatable drum has a cylindrical shape with a cylindrical sidewall and an end wall.

3. The combination washer/dryer machine of claim 2, wherein the seal is attached to the external surface of the cylindrical sidewall of the drum such that the finger is angled relative to the cylindrical sidewall of the drum and extends towards a front end of the tub.

4. The combination washer/dryer machine of claim 3, wherein a second seal including a finger and a securing portion is attached to the external surface of the end wall of the drum such that the finger of the second seal is angled relative to the end wall of the drum and extends away from the shaft and wherein a second ring is attached to the inner surface of an endwall of the tub to provide a resting surface for the finger of the second seal during the drying cycle.

5. The combination washer/dryer machine of claim 2, wherein the seal is attached to the external surface of the end wall of the drum such that the finger is angled relative to the end of the drum and extends away from the shaft.

6. The combination washer/dryer machine of claim 1, wherein the ring includes a gap at a bottom of the ring to enable trapped water to exit the ring.

7. The combination washer/dryer machine of claim 1, wherein the ring includes a plurality of pieces that are secured to the tub and key portions to connect the pieces of the ring together and wherein the ring forms a labyrinth pathway with the finger of the seal to provide the flow restriction that minimizes the bypass of drying air around the external surface of the drum.

8. A combination washer/dryer machine, comprising:

a rotatable drum inside a cabinet, the drum has an external surface and is rotatable by a shaft;

a tub positioned inside the cabinet, the drum rotatable in the tub, the tub has an inner surface; and a seal including a finger and a securing portion that is attached to the inner surface of the tub and a ring that is attached to the external surface of the drum and provides a resting surface for the finger during a drying cycle, wherein the finger of the seal is flexible and arranged at an oblique angle relative to the securing portion such that the finger is angled away from the shaft and remains in contact with the ring during the drying cycle to provide a flow restriction that forces drying air into the drum and minimizes bypass of the drying air.

9. The combination washer/dryer machine of claim 8, wherein the tub has a cylindrical wall and an endwall.

10. The combination washer/dryer machine of claim 9, wherein the seal is attached to the inner surface of the cylindrical wall of the tub such that the finger is angled relative to the cylindrical wall of the tub and extends towards a front end of the drum.

11. The combination washer/dryer machine of claim 10, wherein a second seal including a finger and a securing portion is attached to the inner surface of the endwall of the tub such that the finger of the second seal is angled relative to the endwall of the tub and extends away from the shaft and wherein a second ring is attached to the external surface of an end wall of the drum to provide a resting surface for the finger of the second seal during the drying cycle.

12. The combination washer/dryer machine of claim 9, wherein the seal is attached to the inner surface of the endwall of the tub such that the finger is angled relative to the endwall of the tub and extends away from the shaft.

13. The combination washer/dryer machine of claim 8, wherein the ring includes a plurality of pieces that are secured to the drum.

14. The combination washer/dryer machine of claim 13, wherein the ring includes key portions to connect the pieces of the ring together and wherein the ring forms a labyrinth pathway with the finger of the seal to provide the flow restriction that minimizes the bypass of drying air around the external surface of the drum.

15. A combination washer/dryer machine, comprising:

a cabinet;

a door enabling access into the cabinet;

a washing system;

a drying system;

a tub positioned inside the cabinet, the tub has an inner surface, a cylindrical wall, and an endwall;

a drum that is rotatable in the tub, the drum has a cylindrical sidewall and an end wall and is rotatable by a shaft coupled to the end wall; and a first seal positioned between the cylindrical sidewall of the drum and the cylindrical wall of the tub and a second seal positioned between the end wall of the drum and the endwall of the tub that cooperate to provide flow restrictions that force drying air into the drum and minimize bypass of the drying air, wherein the first seal includes a first finger that is arranged at a first oblique angle relative to the cylindrical sidewall of the drum and that extends at the first oblique angle towards a front end of the tub to contact a first ring positioned on either the cylindrical wall of the tub or the cylindrical sidewall of the drum and wherein the second seal includes a second finger that is arranged at a second oblique angle relative to the end wall of the drum and that extends at the second oblique angle radially outward away from the shaft to contact a second ring positioned on either the endwall of the tub or the end wall of the drum.

16. The combination washer/dryer machine of claim 15, wherein the first seal is positioned on an external surface of the cylindrical sidewall of the drum and the first ring is positioned on the inner surface of the cylindrical wall of the tub.

17. The combination washer/dryer machine of claim 15, wherein the first seal is positioned on the inner surface of the cylindrical wall of the tub and the first ring is positioned on an external surface of the cylindrical sidewall of the drum.

18. The combination washer/dryer machine of claim 15, wherein the second seal is positioned on an external surface of the end wall of the drum and the second ring is positioned on the inner surface of the endwall of the tub.

19. The combination washer/dryer machine of claim 15, wherein the second seal is positioned on the inner surface of the endwall of the tub and the second ring is positioned on an external surface of the end wall of the drum.

* * * * *